US007882934B2

(12) United States Patent
Kocher et al.

(10) Patent No.: US 7,882,934 B2
(45) **Date of Patent: *Feb. 8, 2011**

(54) ELEVATOR INSTALLATION IN A BUILDING WITH AT LEAST ONE TRANSFER FLOOR

(75) Inventors: Hans Kocher, Udligenswil (CH); Stephan Jans, Gelfingen (CH); Jean-Philippe Escher, Thalwil (CH)

(73) Assignee: Inventio AG, Hergiswil NW (CH)

( * ) Notice: Subject to any disclaimer, the term of this patent is extended or adjusted under 35 U.S.C. 154(b) by 19 days.

This patent is subject to a terminal disclaimer.

(21) Appl. No.: 11/962,780

(22) Filed: Dec. 21, 2007

(65) Prior Publication Data

US 2008/0149428 A1 Jun. 26, 2008

Related U.S. Application Data

(60) Provisional application No. 60/871,883, filed on Dec. 26, 2006.

(30) Foreign Application Priority Data

Dec. 22, 2006 (EP) ..... 06127160

(51) Int. Cl.
*B66B 9/00* (2006.01)

(52) U.S. Cl. ..... 187/249

(58) Field of Classification Search ..... 187/249, 187/254

See application file for complete search history.

(56) References Cited

U.S. PATENT DOCUMENTS 4,947,965 A 8/1990 Kuzunuki et al.
5,020,642 A 6/1991 Tsuji
5,058,711 A 10/1991 Tsuji
5,062,502 A 11/1991 Amano
5,090,515 A * 2/1992 Takahashi et al. ..... 187/249
5,584,364 A * 12/1996 Sakita ..... 187/249
5,823,299 A * 10/1998 Wierschke et al. ..... 187/277
6,851,519 B2 * 2/2005 Ach et al. ..... 187/266
7,040,456 B2 * 5/2006 Ach et al. ..... 187/251
7,150,342 B2 * 12/2006 Adifon et al. ..... 187/411

(Continued)

FOREIGN PATENT DOCUMENTS

EP 1 489 033 12/2004

(Continued)

*Primary Examiner*—Thomas J. Brahan
(74) *Attorney, Agent, or Firm*—Fraser Clemens Martin & Miller LLC; William J. Clemens

(57) ABSTRACT

An elevator installation is arranged in a building with at least two elevators, wherein the building is divided into building zones and each elevator has at least one elevator car, each elevator car is independently movable by an associated drive in an associated car zone and each car zone has at least one transfer floor and at least one further transfer floor. A first elevator has at least three elevator cars, which are arranged vertically one above the other and which comprise a middle and two adjacent elevator cars, wherein the middle elevator car is independently movable in a middle car zone and the two adjacent elevator cars are independently movable in two adjacent car zones. The middle car zone and an adjacent car zone serve at least one common floor. In addition, at least one of these car zones is allocated to two building zones.

34 Claims, 7 Drawing Sheets

U.S. PATENT DOCUMENTS

| | | | | |
|---|---|---|---|---|
| 7,357,226 | B2 * | 4/2008 | Sakita | 187/249 |
| 7,360,629 | B2 * | 4/2008 | Hagi et al. | 187/249 |
| 7,367,430 | B2 * | 5/2008 | Ach et al. | 187/254 |
| 7,467,691 | B2 * | 12/2008 | Deplazes et al. | 187/249 |
| 2004/0104079 | A1 * | 6/2004 | Fischer | 187/254 |
| 2005/0077115 | A1 | 4/2005 | Urata | |
| 2005/0087402 | A1 | 4/2005 | Haegi et al. | |
| 2008/0149426 | A1 * | 6/2008 | Kocher | 187/249 |
| 2008/0149428 | A1 * | 6/2008 | Kocher et al. | 187/249 |
| 2008/0302610 | A1 * | 12/2008 | Kocher | 187/249 |

FOREIGN PATENT DOCUMENTS

| | | | | |
|---|---|---|---|---|
| EP | 1 526 103 | | | 4/2005 |
| GB | 2 320 013 | A | | 6/1998 |
| JP | 2004-2042 | A | * | 1/2004 |
| JP | 2004-262650 | A | * | 9/2004 |

* cited by examiner

ELEVATOR INSTALLATION IN A BUILDING WITH AT LEAST ONE TRANSFER FLOOR

CROSS-REFERENCE TO RELATED APPLICATION

This application claims the benefit of U.S. provisional patent application Ser. No. 60/871,883 filed Dec. 26, 2006.

FIELD OF THE INVENTION

The invention relates to an elevator installation in a building with at least one transfer floor.

BACKGROUND OF THE INVENTION

Modern elevator concepts for buildings with thirty and more floors have transfer floors which are served by an elevator installation. Such an elevator installation comprises a group of at least two elevators. A first elevator directly serves the transfer floors from an entrance lobby, i.e. passengers are coarsely distributed relatively quickly from the entrance lobby by a high-speed elevator to the different transfer floors. A second elevator carries out fine distribution of the passengers from the transfer floors to the destination floors thereof.

An elevator usually comprises an elevator car, which is vertically movable in a shaft and receives passengers in order to transport these to a desired floor of a building. In order to be able to look after this task the elevator usually has at least the following elevator components: a drive with a motor and a drive pulley, deflecting rollers, tension means, a counterweight as well as a respective pair of guide rails for guidance of an elevator car and the counterweight.

In that case the motor produces the power required for transport of the passengers present in the elevator car. An electric motor usually looks after this function. This directly or indirectly drives a drive pulley, which is in friction contact with a tension means. The tension means can be a belt or a cable. It serves for suspension as well as conveying the elevator car and the counterweight, which both are so suspended that the gravitational forces thereof act in opposite direction along the tension means. The resultant gravitational force which has to be overcome by the drive, correspondingly substantially reduces. In addition, due to the greater contact force of the tension means with the drive pulley a greater drive moment can be transmitted by the drive pulley to the tension means. The tension means is guided by deflecting rollers.

The optimum utilization of the shaft volume has ever increasing significance in elevator construction. Particularly in high-rise buildings with a high degree of utilization of the building a management of the passenger traffic as efficiently as possible for a given shaft volume is desired. This objective can be achieved firstly by an optimum space-saving arrangement of the elevator components, which creates space for larger elevator cars, and secondly by elevator concepts which enable vertical movement of several independent elevator cars in one shaft.

European patent document EP 1 526 103 shows an elevator installation with at least two elevators in a building, which is divided up into zones. A zone in that case comprises a defined number of floors which are served by an elevator. A zone is allocated to each elevator. A transfer floor is provided in order to go from one zone to another zone. At least one of the elevators has two elevator cars which are movable independently of one another vertically one above the other at two car guide rails. The arrangement of two fetch or carry cars is to assist with preventing unnecessary waiting times at the transfer floors.

An elevator with at least two elevator cars disposed one above the other in the same shaft is shown in European patent document EP 1 489 033. Each elevator car has an associated drive and an associated counterweight. The drives are arranged near first and second shaft walls and the counterweights are also respectively suspended below the associated drive at drive or holding cables near first or second shaft walls. The axes of the drive pulleys of the drives are disposed perpendicularly to the first and second shaft walls. The two independently movable elevator cars ensure a high conveying performance. The positioning of the drives in the shaft near first or second walls renders a separate engine room superfluous and enables a space-saving, compact arrangement of the drive elements in the shaft head.

SUMMARY OF THE INVENTION

An object of the present invention is to further increase the conveying performance of an elevator installation for a given shaft cross-section in a building with zonal division and at least one transfer floor.

The elevator installation according to the present invention lies in a building with at least two elevators, wherein the building is divided into building zones and each elevator has at least one elevator car. Each elevator car is movable independently by way of an own drive in an associated car zone. In addition, each car zone has at least one transfer floor.

A first elevator has at least three elevator cars which are arranged vertically one above the other in a shaft and which comprise a middle and two adjacent elevator cars, wherein the middle elevator car is independently movable in a middle car zone and the two adjacent elevator cars are independently movable in two adjacent car zones. The middle car zone and an adjacent car zone in that case serve at least one common floor. In addition, at least one of these car zones is allocated to two building zones.

Thanks to the at least three elevator cars, which are movable independently one above the other, of an elevator the elevator installation has a significantly higher conveying performance. Waiting times at transfer floors are thus further reduced and the creation of waiting loops largely avoided. In addition, the elevator installation has a greater flexibility in the allocation of journeys, because the change from one building zone to the next is possible in a classic elevator model only by way of the transfer floors. Here, regions of adjacent building zones can be reached without transfer by way of a transfer floor. A further advantage of the elevator installation with such overlapping car zones is that passengers can transfer from a middle car zone to an adjacent car zone at any desired floor lying in the overlap region of the car zones. This makes possible a more flexible guidance of the passengers. In addition, floors in the overlap region of the car zones are served by two elevator cars and thus the conveying performance of the elevator installation is increased.

Advantageously this at least one elevator car of a second elevator is a multi-car with at least two cars arranged vertically one above the other. These two cars are associated with the same car zone, since they are physically connected and can thus be moved only in common.

The advantage of the elevator installation with a double-car resides in the doubling of the available car volume of an elevator car. Thus, up to twice as many passengers can be conveyed by one journey.

Advantageously the multi-car serves at least two transfer floors disposed one above the other.

The advantage of the elevator installation is that in the case of doubling of the transfer floors the waiting times on the respective transfer floors can be further reduced. The transfer floors have a transfer or waiting space for the transfer. In the case of a doubled number of such transfer spaces the transfer takes place substantially free of conflict and if, notwithstanding the increased conveying performance waiting times should nevertheless occur, the passengers have available twice the volume of waiting space. Staying in the transfer floors or transfer or waiting spaces is thus more pleasant in every instance.

Advantageously the at least three car zones can be allocated to at least two adjacent building zones. Equally advantageously the middle car zone is allocated to a building zone and the two adjacent car zones are each allocated to the same building zone and an adjacent upper or lower building zone.

The advantage of the elevator installation resides in the flexible passenger guidance. In this embodiment it is possible to change from one floor of a building zone to a floor of an adjacent building zone without the possible transfer by way of a transfer floor having to be taken into account.

Advantageously the at least three drives associated with the elevator cars can be moved past by the elevator cars.

The elevator installation has the advantage that the drives can be arranged in a space-saving and flexible manner in the shaft without coming into conflict with the elevator cars.

Advantageously the at least three drives associated with the elevator cars are positioned at a first shaft wall or a second, opposite shaft wall.

The advantage of the elevator installation resides in the position of the drives between the elevator cars and the first and second shaft walls. Space in the shaft head or shaft pit, where the drives are usually arranged, can thereby be saved.

Advantageously the drive of the middle elevator car is positioned at the first shaft wall and the two drives of the adjacent elevator cars are positioned at the opposite, second shaft wall.

The advantage of the elevator installation resides in the flexible and simple positioning of however many drives and the associated elevator cars in the same shaft. In a conventional arrangement of the drives in the shaft head, thereagainst, the number of drives which can be installed is limited by the space available in the shaft head. Equally, a guidance of the tension elements free of conflict in such a conventional arrangement of the drives in the shaft head is subject to close limits.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The U.S. provisional patent application Ser. No. 60/871,883 filed Dec. 26, 2006 is hereby incorporated herein by reference.

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

The elevator shaft is a space which is defined by six boundary planes and in which one or more elevator cars are moved along a travel path. Usually four shaft walls, a ceiling and a floor form these six boundary planes. This definition of a shaft can be extended in the manner that several travel paths, along each of which one or more elevator cars are movable, can also be arranged in a shaft horizontally adjacent to one another.

Figure 1:
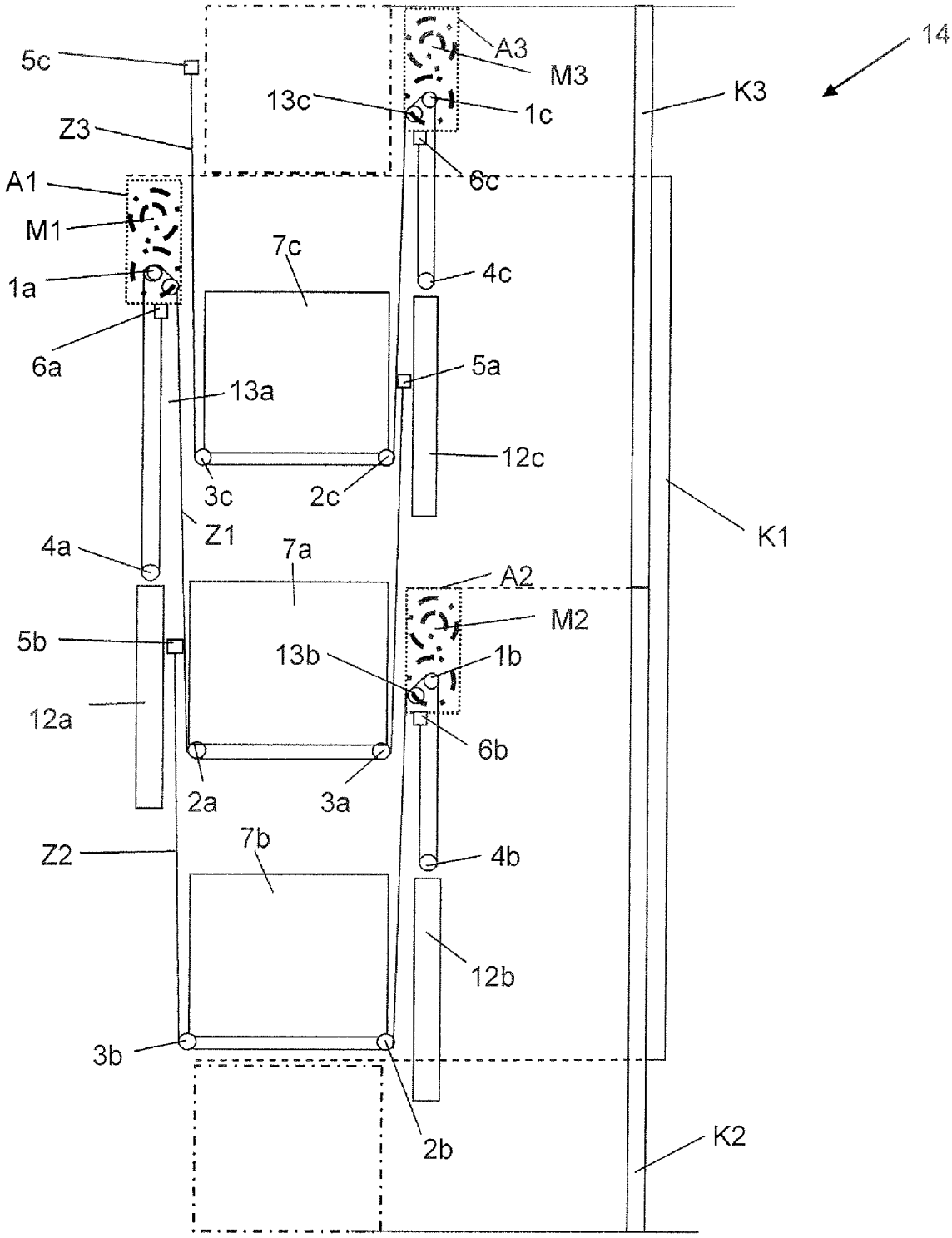
FIG. 1 is a schematic side elevation view of an arrangement of an elevator of an elevator installation with three elevator cars, three drives, three drive pulleys, three tension means and several deflecting rollers in accordance with the present invention.

FIG. 1 shows an elevator with at least three elevator cars 7*a*, 7*b*, 7*c* which each have an associated drive A1, A2, A3 and are movable independently of one another in a vertical direction. In that case a middle elevator car 7*a* is arranged between two adjacent elevator cars 7*b*, 7*c*, which are disposed respectively below and above the middle elevator car 7*a*.

The associated drives A1, A2, A3 are positioned laterally at first and second shaft walls. The first and second shaft walls are those mutually opposite shaft walls not having shaft doors. The drive A1 of the middle elevator car 7*a* is positioned at the first shaft wall and the two drives A2, A3 of the adjacent elevator cars 7*b*, 7*c* are positioned at the opposite second shaft wall. In that case the drives A1, A2, A3 are positioned in alternation on opposite shaft walls. Additional drives (not shown) of further elevator cars are alternately arranged at first and second shaft walls in correspondence with the alternating ordering of the drives.

The drives A1, A2, A3 are positioned in FIG. 1 at three different shaft heights, wherein the drives A2, A3 of the adjacent elevator cars 7*b*, 7*c* are positioned above or below the drive A1 of the middle elevator car 7*a*. As a rule the distance in a vertical direction between the middle drive A1 and an adjacent drive A2, A3 is at least one car height.

It is, however, also possible to position two drives at the same shaft height. For example, the drive A1 of the middle elevator car 7*a* can be arranged on the first shaft wall and the drive A3 of the adjacent, upper elevator car 7*c* on the opposite, second shaft wall at the same shaft height. The advantage of this arrangement resides in the simple maintenance of the two drives A1, A3. These can, in particular, be maintained from a common platform.

The drive A1, A2, A3 has a respective motor M1, M2, M3 and a respective drive pulley 1*a*, 1*b*, 1*c*. The motor M1, M2, M3 is disposed in operative contact with the drive pulley 1*a*, 1*b*, 1*c* and drives a tension means Z1, Z2, Z3 by means of this drive pulley 1*a*, 1*b*, 1*c*. The drive pulley 1*a*, 1*b*, 1*c* is so designed that it is suitable for receiving one or more tension means Z1, Z2, Z3. The tension means Z1, Z2, Z3 are preferably belts, such as wedge-ribbed belts with ribs at one side which engage in one or more depressions at the drive pulley side. Belt variants such as smooth belts and belts toothed on one side or both sides with corresponding drive pulleys 1*a*, 1*b*, 1*c* are equally usable. In addition, different kinds of cables such as single cables, double cables or multiple cables are also usable. The tension means Z1, Z2, Z3 comprise strands of steel wire or aramide or Vectran (a registered trademark of CNA Holdings, Inc. of Summit, N.J.) fibers.

The at least three elevator cars 7*a*, 7*b*, 7*c* and three counterweights 12*a*, 12*b*, 12*c* are suspended at the tension means Z1, Z2, Z3 in a block-and-tackle manner. In that case the elevator cars 7*a*, 7*b*, 7*c* have at least one first and at least one second deflecting roller 2*a*, 2*b*, 2*c*, 3*a*, 3*b*, 3*c* which are fastened in the lower region of the elevator cars 7*a*, 7*b*, 7*c*. These deflecting rollers 2*a*, 2*b*, 2*c*, 3*a*, 3*b*, 3*c* have, at the outer circumference, one or more grooves which are such that they can receive one or more tension means Z1, Z2, Z3. The deflecting rollers 2*a*, 2*b*, 2*c*, 3*a*, 3*b*, 3*c* are thus suitable for the guidance of the tension means Z1, Z2, Z3 and are brought into contact with the latter. An elevator car 7*a*, 7*b*, 7*c* is thus preferably suspended as a lower block-and-tackle.

In an optional form of embodiment the deflecting rollers 2*a*, 2*b*, 2*c*, 3*a*, 3*b*, 3*c* are disposed in the upper region of the elevator car 7*a*, 7*b*, 7*c*. In correspondence with the above description, the elevator car 7*a*, 7*b*, 7*c* is then suspended as an upper block-and-tackle.

Disposed in the upper region of the counterweights 12*a*, 12*b*, 12*c* is a third deflecting roller 4*a*, 4*b*, 4*c*, which is similarly suitable, analogously to the deflecting rollers 2*a*, 2*b*, 2*c*, 3*a*, 3*b*, 3*c* to receive one or more of the tension means Z1, Z2, Z3. Correspondingly, the counterweight 12*a*, 12*b*, 12*c* is preferably suspended at the third deflecting roller 4*a*, 4*b*, 4*c* as an upper block-and-tackle below the associated drive A1, A2, A3.

The tension means Z1, Z2, Z3 is led from a first fixing point 5*a*, 5*b*, 5*c* to a second fixing point 6*a*, 6*b*, 6*c* via the first, second and third deflecting rollers 2*a*, 2*b*, 2*c*, 3*a*, 3*b*, 3*c*, 4*a*, 4*b*, 4*c* and the drive pulley 1*a*, 1*b*, 1*c* from the first shaft wall to the second shaft wall. The first fixing point 5*a*, 5*b*, 5*c* is in that case disposed opposite the associated drive A1, A2, A3 at approximately the same shaft height in the vicinity of the first or second shaft wall. The second fixing point 6*a*, 6*b*, 6*c* is disposed in the vicinity of the associated drive A1, A2, A3 on an opposite second or first shaft wall.

The tension means Z1, Z2, Z3 runs from the first fixing point 5*a*, 5*b*, 5*c* along a first or second shaft wall downwardly to the second deflecting roller 3*a*, 3*b*, 3*c*, loops around this from the outside to the inside at an angle of approximately 90° and leads to the first deflecting roller 2*a*, 2*b*, 2*c*. The tension means Z1, Z2, Z3 loops around this first deflecting roller 2*a*, 2*b*, 2*c* from the inside to the outside again through approximately 90° and is thereafter led along the elevator car 7*a*, 7*b*, 7*c* upwardly to the drive pulley 1*a*, 1*b*, 1*c* and loops around this from the inside to the outside through approximately 150°. Depending on the setting of the optional setting pulley 13*a*, 13*b*, 13*c* the looping angle can be set in a range of 90 to 180°. The tension means Z1, Z2, Z3 is thereafter led along a second or first shaft wall downwardly to the third deflecting pulley 4*a*, 4*b*, 4*c* loops around this from the outside to the inside through approximately 180° and is again led along a second or first shaft wall upwardly to the second fixing point 6*a*, 6*b*, 6*c*.

As mentioned above, the setting pulley 13*a*, 13*b*, 13*c* is an optional component of the drive A1, A2, A3. With this setting pulley 13*a*, 13*b*, 13*c* the looping angle of the tension means Z1, Z2, Z3 at the drive pulley 1*a*, 1*b*, 1*c* can be set, or increased or reduced, in order to transmit the desired traction forces from the drive pulley 1*a*, 1*b*, 1*c* to the tension means Z1, Z2, Z3. Depending on the respective spacing of the setting pulley 13*a*, 13*b*, 13*c* from the drive pulley 1*a*, 1*b*, 1*c* the spacing of the tension means Z1, Z2, Z3 from the drive A1, A2, A3, from the counterweight 12*a*, 12*b*, 12*c* or from the elevator car 7*a*, 7*b*, 7*c* can additionally be set. A conflict-free guidance of the tension means Z1, Z2, Z3 in the shaft between the drive pulley 1*a*, 1*b*, 1*c* and the first deflecting roller 2*a*, 2*b*, 2*c* is thus guaranteed.

The elevator car 7*a*, 7*b*, 7*c* as well as the respectively the associated drives A1, A2, A3, the drive pulleys 1*a*, 1*b*, 1*c*, the deflecting rollers 2*a*, 2*b*, 2*c*, 3*a*, 3*b*, 3*c*, 4*a*, 4*b*, 4*c*, the optional setting pulleys 13*a*, 13*b*, 13*c*, the counterweights 12*a*, 12*b*, 12*c*, the tension means Z1, Z2, Z3 and the fixing points 5*a*, 5*b*, 5*c*, 6*a*, 6*b*, 6*c* form an elevator unit. Consequently, FIG. 1 shows an elevator which has three elevator units, which in turn forms a triple group 14.

Proceeding from the middle elevator unit with the elevator car 7*a*, the adjacent lower elevator unit with the elevator car 7*b* and an adjacent upper elevator unit with elevator car 7*c* are respectively arranged in mirror image with respect to the middle one. The drives A1, A2, A3 of the elevator units thus lie on mutually opposite first or second shaft walls and the associated drive pulleys 1*a*, 1*b*, 1*c*, the deflecting rollers 2*a*, 2*b*, 2*c*, 3*a*, 3*b*, 3*c*, 4*a*, 4*b*, 4*c*, the setting pulleys 13*a*, 13*b*, 13*c*, the counterweights 12*a*, 12*b*, 12*c*, the tension means Z1, Z2, Z3 and the fixing points 5*a*, 5*b*, 5*c*, 6*a*, 6*b*, 6*c* of adjacent elevator cars 7*a*, 7*b*, 7*c* are also arranged in mirror image. This rule of mirror-image arrangement of middle and adjacent elevator units applies to any desired number of elevator units installed in a shaft.

A further characteristic of the arrangement of the elevator units is that the associated drives A1, A2, A3 and first fixing points 5*a*, 5*b*, 5*c* are positioned at approximately the same height at opposite first and second shaft walls. The shaft height predetermined by the fixing points 5*a*, 5*b*, 5*c* and the drives A1, A2, A3 is also at the same time the highest point which an associated elevator car 7*a*, 7*b*, 7*c* can reach, since the tension means in the illustrated form of embodiment cannot raise a suspension point of a elevator car 7*a*, 7*b*, 7*c* above the height of the drive pulley 1*a*, 1*b*, 1*c*. The positioning of the drives A1, A2, A3 and the first fixing points 5*a*, 5*b*, 5*c* of the middle and adjacent elevator cars 7*a*, 7*b*, 7*c* is usually carried out at different shaft heights. The elevator cars 7*a*, 7*b*, 7*c* can thus reach only different maximum shaft heights. Correspondingly, the middle and the adjacent elevator cars 7*a*, 7*b*, 7*c* are allocated to different car zones in which the elevator cars 7*a*, 7*b*, 7*c* are movable.

The car zones K1, K2, K3 allocated to the elevator cars 7*a*, 7*b*, 7*c* are evident in FIG. 1. It is apparent therefrom that the shaft height of a drive A1, A2, A3 in the afore-described configuration predetermines the maximum shaft height of such a car zone K1, K2, K3. The minimum shaft height of a car zone K1, K2, K3, thereagainst, is defined by the drive A1, A2, A3 of the next-but-one elevator unit disposed thereunder. In the illustrated example of embodiment the counterweight 12*c* of the adjacent upper elevator car 7*c* and the drive A2 of the next-but-one adjacent lower elevator car 7*b* disposed thereunder is disposed, due to the mirror-image construction of middle and adjacent elevator units, on the same first or second shaft wall. The deepest shaft height reachable by the counterweight 12*c* is thus limited by the drive A2 disposed thereunder on the same shaft wall. The travel range of the counterweight 12*c* between drive A2 and the drive A3 thus defines, for simultaneous 2:1 suspension of the associated elevator car 7*c* and counterweight 12*c*, the car zone K3 of the elevator car 7*c*.

If use is made of this teaching for the triple group 14, partly overlapping car zones K1, K2, K3 result, wherein only middle and adjacent car zones K1, K2, K3 overlap. In a high-rise building with several triple groups 14 arranged one above the other all floors disposed in a middle car zone K1 are thus served by two elevator cars.

Figure 2:
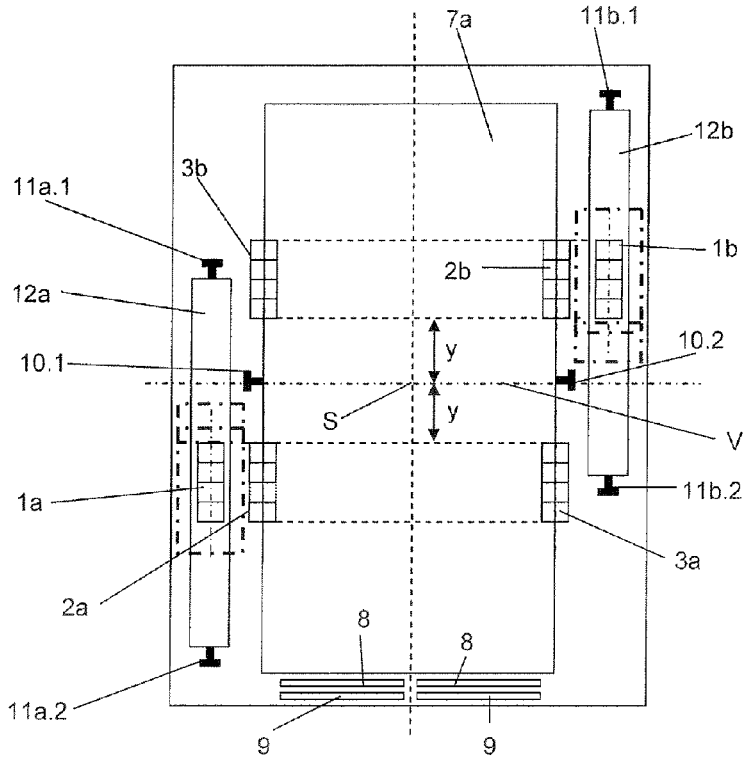
FIG. 2 is a schematic plan view of an arrangement of the middle elevator car of the elevator installation according to FIG. 1.

According to FIG. 2 the elevator cars 7*a*, 7*b*, 7*c* are guided by two car guide rails 10.1, 10.2. The two car guide rails 10.1, 10.2 form a connecting plane V which extends in each instance approximately through the center of gravity S of the two elevator cars 7*a*, 7*b*, 7*c*. In the illustrated form of embodiment the elevator cars 7*a*, 7*b*, 7*c* are suspended eccentrically. Here only the arrangement of two elevator units arranged directly one above the other is shown. However, it is clear to the expert that the arrangement for further pairs of elevator units arranged directly one above the other takes place analogously thereto.

The tension means Z1, Z2, Z3 and the associated guide means, such as deflecting rollers 2*a*, 2*b*, 2*c*, 3*a*, 3*b*, 3*c*, 4*a*, 4*b*, 4*c* and drive pulleys 1*a*, 1*b*, 1*c*, in this suspension arrangement lie on one side of the connecting plane V, wherein the deflecting rollers 4*a*, 4*b*, 4*c* are, for the sake of clarity, not illustrated in FIG. 2, i.e. all afore-mentioned components associated with a elevator car 7*a*, 7*b*, 7*c* lie either between third shaft walls and the connecting plane V or between fourth shaft walls and the connecting plane V. Third or fourth shaft walls denote shaft walls which have at least one shaft door 9 and the opposite shaft walls. A spacing y of the tension means Z1, Z2, Z3 and the connecting plane V is advantageously approximately the same. The tension means Z1, Z2, Z3 of the elevator car 7*a*, 7*b*, 7*c* lie alternately on one or the other side of the connecting plane V. Thus, the moments produced by the eccentric suspension of the elevator cars 7*a*, 7*b*, 7*c* have opposite effect. In the case of the same rated load of the elevator cars 7*a*, 7*b*, 7*c* and in the case of an even number of the elevator cars 7*a*, 7*b*, 7*c* the moments acting on the guide rails 10.1, 10.2 significantly rise.

The counterweights 12*a*, 12*b*, 12*c* are guided by two counterweight guide rails 11*a*.1, 11*a*.2, 11*b*.1, 11*b*.2. The counterweights 12*a*, 12*b*, 12*c* are positioned at opposite shaft walls between the car guide rails 10.1, 10.2 and first or second shaft walls. Advantageously, the counterweights 12*a*, 12*b*, 12*c* are suspended at their center of gravity at the tension means Z1, Z2, Z3. Since the elevator cars 7*a*, 7*b*, 7*c* are eccentrically suspended, the counterweights 12*a*, 12*b*, 12*c* are laterally offset in the vicinity of third and fourth shaft walls.

The axes of rotation of the drive pulleys 1*a*, 1*b*, 1*c* and of the deflecting rollers 2*a*, 2*b*, 2*c*, 3*a*, 3*b*, 3*c*, 4*a*, 4*b*, 4*c* lie parallel to the first or second shaft walls. In the illustrated embodiment the afore-mentioned components are of the form that they can accept four parallelly extending tension means Z1, Z2, Z3, guide these or, in the case of the drive pulley 1*a*, 1*b*, 1*c*, also drive these. In order to be able to receive the tension means Z1, Z2, Z3 the deflecting rollers 2*a*, 2*b*, 2*c*, 3*a*, 3*b*, 3*c*, 4*a*, 4*b*, 4*c* and the drive pulleys 1*a*, 1*b*, 1*c* have four specially constructed contact surfaces, which in the case of cables are designed, for example, as grooves or in the case of belts, for example, also as dished surfaces or toothing or, in the case of a contact surface of flat construction, are provided with guide shoulders. These four contact surfaces can be formed either on a common roller-shaped base body or respectively on four individual rollers with a common axis of rotation.

With knowledge of this form of embodiment numerous possibilities of variation according to the respective objective are available to the expert. Thus, this can arrange one to four or more individual rollers with or without a spacing relative to one another on one axis of rotation. In that case each roller can accept, depending on the respective design, one to four or, in the case of need, even more tension means Z1, Z2, Z3.

In normal operation of the elevator the elevator cars 7*a*, 7*b*, 7*c* are placed at a floor stop flush with the floor and the car doors 8 are opened together with the shaft doors 9 so as to enable transfer of passengers from the floor to the elevator cars 7*a*, 7*b*, 7*c* and conversely.

Figure 3:
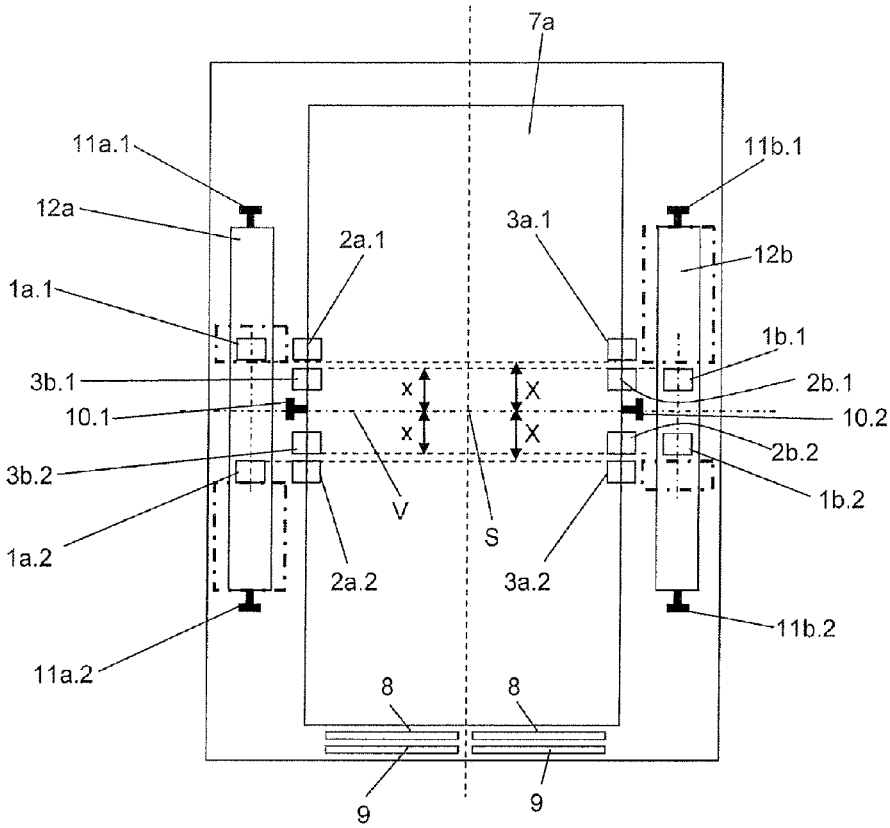
FIG. 3 is a schematic plan view of an optional arrangement of the middle elevator of the elevator installation according to FIG. 1.

FIG. 3 shows an alternative suspension arrangement with centrally suspended elevator cars 7*a*, 7*b*, 7*c*. Here only the arrangement of two elevator units arranged directly one above the other is shown. However, it will be clear to the expert that the arrangement for further pairs of elevator units arranged directly one above the other takes place analogously thereto.

In that case the tension means Z1, Z2, Z3 are led from the deflecting rollers and drive pulleys 1*a*, 1*b*, 1*c* on both sides of the connecting plane V. Advantageously, the suspension is then arranged symmetrically with respect to the connecting plane V. Since in this case the suspension center of gravity substantially coincides with the center of gravity S of the elevator cars 7*a*, 7*b*, 7*c* no additional moments act on the car guide rails 10.1, 10.2.

In this central suspension of the elevator cars 7*a*, 7*b*, 7*c*, associated deflecting rollers 2*a*.1, 2*a*.2, 2*b*.1, 2*b*.2, 3*a*.1, 3*a*.2, 3*b*.1, 3*b*.2 and drive pulleys 1*a*.1, 1*a*.2, 1*b*.1, 1*b*.2 consist of at least two rollers arranged on the left and right of the connecting plane V. The deflecting rollers 4*a*, 4*b*, 4*c* of the counterweights 12*a*, 12*b*, 12*c* similarly consist of two rollers arranged on the left and the right of the connecting plane V, but for the sake of clarity not illustrated in FIG. 3. In the present example the deflecting rollers 2*a*.1, 2*a*.2, 3*a*.1, 3*a*.2 and the drive pulleys 1*a*.1, 1*a*.2, which are associated with the middle elevator car 7*a*, lie at a first spacing x from the connecting plane V and the deflecting rollers 2*b*.1, 2*b*.2, 3*b*.1, 3*b*.2 and the drive pulley 1*b*, which are associated with the adjacent lower elevator car 7*b*, at a second spacing X from the connecting plane V, wherein the first spacing x is smaller than the second spacing X. A conflict-free guidance of the tension means Z1, Z2, Z3 in the case of central suspension of the elevator cars 7*a*, 7*b*, 7*c* is thereby guaranteed.

Here, too, the counterweights 12*a*, 12*b*, 12*c* are advantageously suspended at their center of gravity S at the tension means Z1, Z2, Z3 between the car guide rails 10.1, 10.2 and the first or second shaft walls. Since the elevator cars 7*a*, 7*b*, 7*c* are now centrally suspended, the counterweights 12*a*, 12*b*, 12*c* also lie in a central region of the first and second shaft walls. Thanks to this central position of the counterweights 12*a*, 12*b*, 12*c* the free space between the lateral ends of the counterweights 12*a*, 12*b*, 12*c* and third and fourth shaft walls increases. Design freedom for the counterweights 12*a*, 12*b*, 12*c* is thereby gained. Thus, for example, a narrower and wider counterweight 12*a*, 12*b*, 12*c* can be used in order to better utilize the space. For a given shaft cross-section, the elevator car 7*a*, 7*b*, 7*c* gains width or, for a given car size, the shaft cross-section can be reduced.

Figure 5:
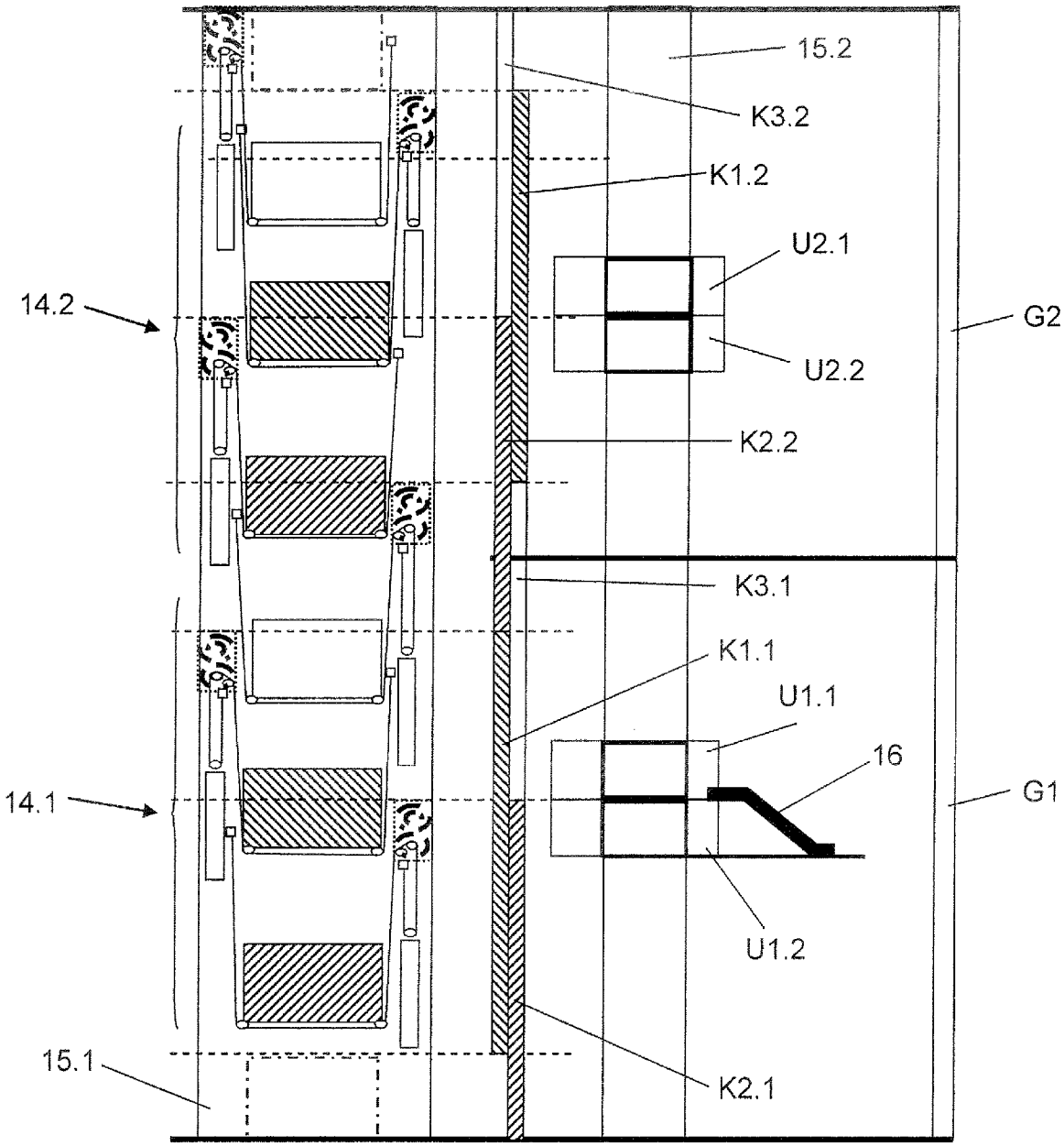
FIG. 5 is a schematic side elevation view of an elevator installation according to the present invention in a building with two building zones.
Figure 6:
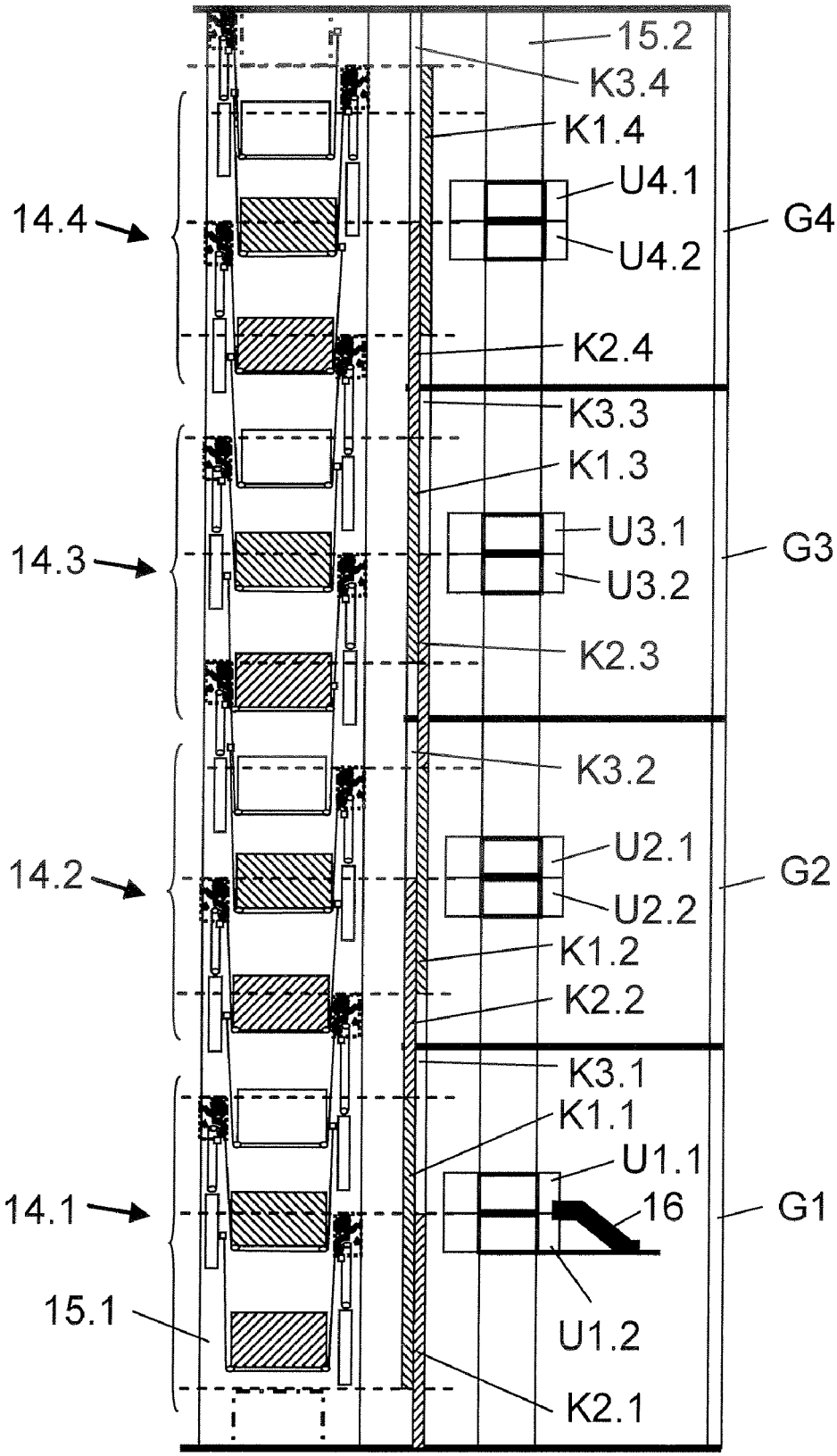
FIG. 6 is a schematic side elevation view of an elevator installation according to the present invention in a building with four building zones.

The centric and eccentric suspension variants, which are shown in FIGS. 2 and 3, can be combined as desired with the following examples of FIGS. 5 and 6.

Figure 4:
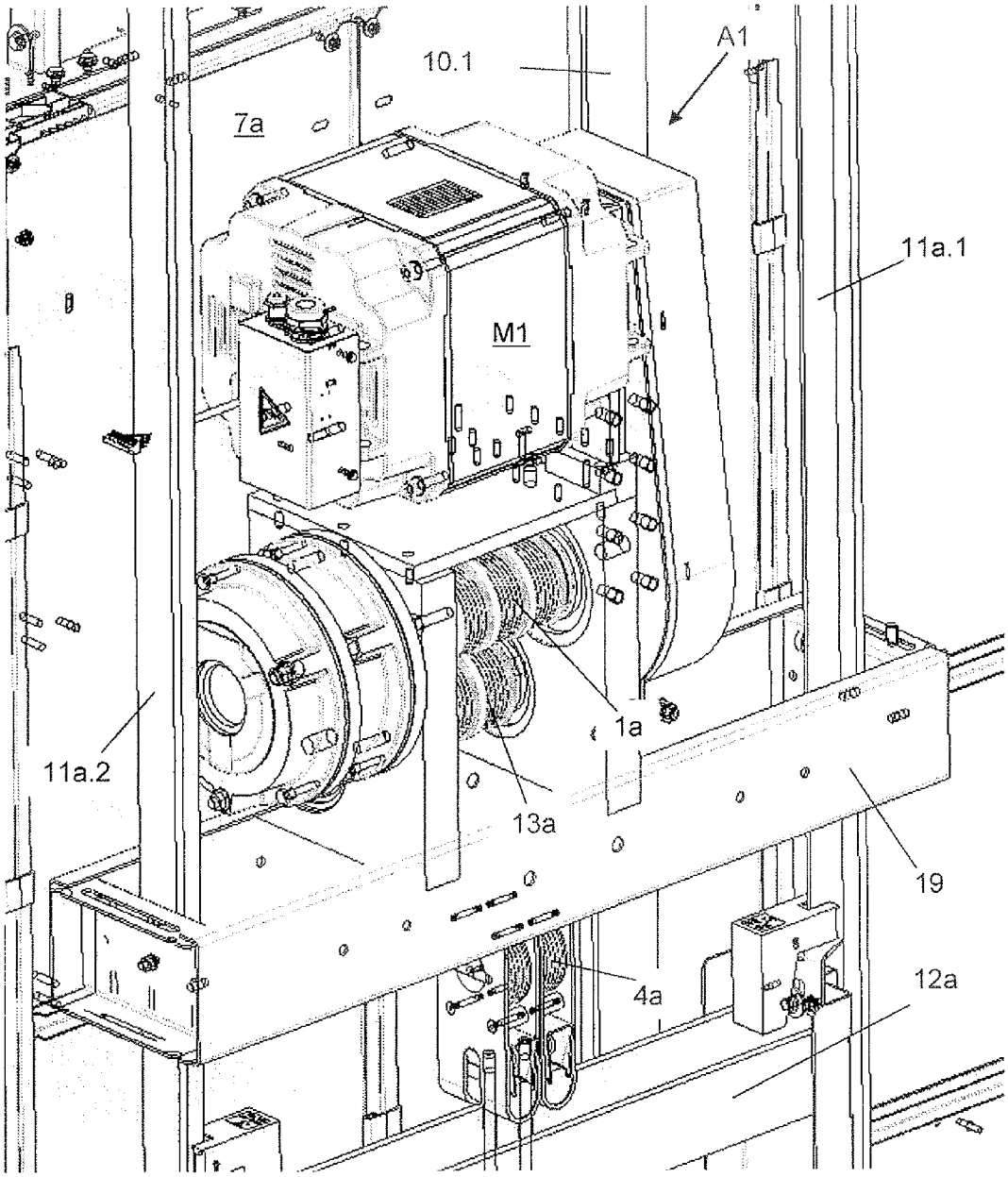
FIG. 4 is a perspective view of an arrangement of the drives on cross members according to the present invention.

As shown in FIG. 4, the drive A1 has a motor M1, preferably an electric motor, a drive pulley 1*a* and optionally a setting pulley 13*a* by which the looping angle of the tension means Z1 about the drive pulley 1*a* and the horizontal spacing of the tension means Z1 from the drive A1 to the elevator car 7*a* or the counterweight 12*a* can be set.

The motor M1 lies vertically above the drive pulley 1*a*. Thanks to this arrangement the drive can be positioned in the clear projection of the counterweight 12*a* between the elevator car 7*a* and the first or second shaft walls. The drive A1 can thereby be moved past by the elevator car 7*a* and can thus be mounted in an otherwise unneeded space of the shaft. By comparison with conventional elevators without an engine room there is thereby obtained space in the shaft head and/or in the shaft pit.

According to FIG. 4 the drive A1 is fixed on a cross member 19, which is fastened to the car guide rail 10.1 and/or to the counterweight guide rails 11*a*.1, 11*a*.2. There can be further seen in FIG. 4 the third deflecting roller 4*a*, at which the counterweight 12*a* is suspended, and in the background the elevator car 7*a*. The example shown here is in mirror image with respect to the connecting plane V by comparison with the arrangement of FIG. 2.

The drives can also be optionally fixed directly on the shaft walls and in that case the cross members 19 are saved.

FIG. 5 shows an elevator installation for a building with zonal division. A building zone G1, G2 is composed of several floors of the building arranged vertically one above the other. In that case at least one of these floors of a building zone G1, G2 is a so-termed transfer floor "U1", "U2". It is usual to go from one building zone G1 to another building zone G2 by means of a feeder elevator which stops only at the transfer floors. Here this feeder elevator is designed as a high-speed elevator. The number of remaining floors which are allocated to a building zone G1, G2 is defined by those floors which are served by a take-away elevator 14.1, 14.2. This take-away elevator 14.1, 14.2 undertakes fine distribution of the passengers from the transfer floors "U1", "U2" to the destination floors thereof. In the illustrated example a certain number of floors which are served by two take-away elevators 14.1, 14.2 of adjacent building zones G1, G2 is provided in the edge region of two adjacent building zones G1, G2. The boundary of the building zones G1, G2 is fixed by the center of this edge zone.

The building is here divided into the two building zones G1, G2. Allocated to each of these building zones G1, G2 is a triple group 14.1, 14.2. The elevator installation further comprises two elevators which are arranged in two shafts 15.1, 15.2. Disposed in the first shaft 15.1 are two triple groups 14.1, 14.2, which are arranged vertically one above the other, with six elevator units and the associated six car zones K1.1, K1.2, K1.3, K2.1, K2.2, K2.3.

A high-performance elevator which exclusively serves transfer floors U1.2, U1.1, U2.1, U2.2 is moved in the second elevator shaft 15.2. This high-performance elevator is, in the illustrated example, a double-decker elevator with two fixedly connected cars which are arranged vertically one above the other and movable in common in the shaft 15.2. These double-decker cars serve two transfer floors U1.2, U1.1, U2.1, U2.2 arranged directly one above the other.

A primary task of the two triple groups 14.1, 14.2 is the transport of passengers from the transfer floors U1.1, U1.2, U2.1, U2.2 to the destination floors of the corresponding building zone G1, G2 and back again. The triple groups 14.1, 14.2, however, also ensure transport within the respective building zone G1, G2 as well as to a region of the adjoining building zone G1, G2.

Accordingly, the first car zone K3.1 of the first triple group 14.1 and the lowermost car zone K2.2 of the second triple group 14.2, which both lie at the boundary of the building zones G1, G2, each have a region of floors which respectively lies in the adjoining building zone G1, G2. It is now possible within one of the said car zones K3.1, K2.2 to reach floors of the respective adjoining building zone G1, G2. This offers, apart from the classic change of building zones G1, G2 via the transfer floor U1.1, U1.2, U2.1, U2.2, additional possibilities in order to pass from one building zone G1, G2 to another, adjoining building zone G1, G2. Thanks to this arrangement, which extends over building zones, of the triple groups 14.1, 14.2 the elevator installation is distinguished by a flexible allocation of journeys.

Each car zone K1.1, K1.2, K1.3, K2.1, K2.2, K2.3 in each building zone G1, G2 has at least one of the transfer floors U1.1, U1.2, U2.1, U2.2. The following arrangement, by way of example, results in the upper building zone G2: the transfer floors U2.1, U2.2 of the double-decker elevator lie in a central region of the building zone G2, the lower transfer floor U2.2 is served by the lower car of the double-decker car and the middle and lower adjacent elevator car of the triple group 14.1 and the upper transfer floor U2.1 is served correspondingly by the upper car of the double-decker car and the middle and upper adjacent elevator car of the triple group 14.2. Thus, passengers whose destination floor lies in the middle car zone K1.2 always have available two elevator cars of the triple group 14.2 for onward travel.

The adjacent car zones K2.2, K3.2 preferably each contain half the floors of a building zone G2. Towards the top the upper car zone K3.2 is bounded by the end of the car zone G2. The lower car zone K2.2, thereagainst, extends beyond the lower end of the building zone G2 into the building zone G1 and is bounded downwardly by the middle car zone K11 of the building zone G1 or by the associated drive.

The middle car zone K1.2 has at least two floors, which correspond with the transfer floors. Preferably, however, the middle car zone K1.2 extends over as many floors as possible of the building zone G2. Towards the top the middle car zone K1.2 is bounded by the elevator car of the upper adjacent car zone K3.2, because the elevator car of the middle car zone K1.2 cannot, due to the vertical stacking of the elevator cars of a triple group 14.2, move past the upper adjacent elevator car. The lower boundary of the middle car zone K1.2 results from the position of the drive which is associated with the next-but-one elevator car disposed thereunder. This drive is allocated to the upper car zone K3.1 of the lower triple group 14.1. In the case of minimum size of the middle car zone K1.2 of two floors the middle elevator car of the triple group 14.2 takes over for the building zone G2 the function of an escalator 16, in that it transports passengers from the upper transfer floor U2.1 to the lower transfer floor U2.2 and conversely.

The lower triple group 14.1 and the associated car zones K11.1, K2.1, K3.1 are arranged in point symmetrical manner with respect to the upper triple group 14.2, wherein the point of symmetry lies in the center of the shaft 15.1 at a shaft height corresponding with the boundary line between the building zones G1, G2. Correspondingly, the transfer floors U1.1, U1.2 also lie in a middle region of the building zone G1. The middle car zone K1.1 serves both transfer floors U1.1, U1.2 as well as further floors of the building zone G1. The car zone K11 is bounded at the top by its associated drive and at the bottom by the lower adjacent elevator car. The upper adjacent car zone K3.1 is arranged, analogously to the lower car zone K2.2 of the upper building zone G2, to extend over building zones. The car zone K3.1 extends from its associated drive downwardly to the drive of the next-but-one elevator car which is disposed thereunder and which serves the floors in the car zone K2.1. This lower adjacent car zone K2.1 adjoins at the top, as stated, the upper adjacent car zone K3.1 and at the bottom the lower end of the building zone G1.

The two transfer floors U1.1, U1.2 of the lower building zone G1 are connected by the escalator 16. The escalators are often used in building lobbies. The building lobbies are floors in which the passengers enter the building and also leave again and are accordingly frequented by numerous passengers. If, for example, the lower transfer floor U1.2 is now a building lobby, the inflowing passengers now pass, in the case of need, rapidly to the upper transfer floor U1.1 thanks to the high conveying performance of the roller escalator 16 or pass, when leaving the building, rapidly from this back to the building lobby. Depending on the respective kind and position of the building the building lobby can in principle lie on any floor of the building. The building lobby is in that case usually served by at least one high-speed elevator of the second shaft 15.2.

The example shown in FIG. 5 is continuously served by two elevator cars of the triple groups arranged vertically one above the other in the first shaft 15.1. An exception is formed solely by the uppermost and the lowermost floor of the building. These two floors are served only by the elevator car of the uppermost and lowermost car zone K2.1, K3.2. This is a substantial advantage by comparison with a classic elevator installation with triple groups 14.1, 14.2 allocated exclusively to a building zone G1, G2, because in such classic elevator installations there are in each instance two boundary floors, which are served by only one elevator car, per building zone G1, G2. Thus, the described elevator installation has a particularly high conveying performance.

FIG. 6 shows a building with an elevator installation which is configured according to the example of FIG. 4. The building here has, however, two additional building zones G3, G4 with two associated triple groups 14.3, 14.4. These two triple groups 14.3, 14.4 have six elevator cars, which are movable in six associated car zones K1.3, K2.3, K3.3, K1.4, K2.4, K3.4. In addition, two respective transfer floors U3.1, U3.2, U4.1, U4.2 are associated with each of the two additional building zones G3, G4. According to this example, any number of triple groups can be arranged in a shaft 15.1 vertically one above the other depending on the respective building height or number of floors which form a building zone G1, G2, G3, G4.

Figure 7:
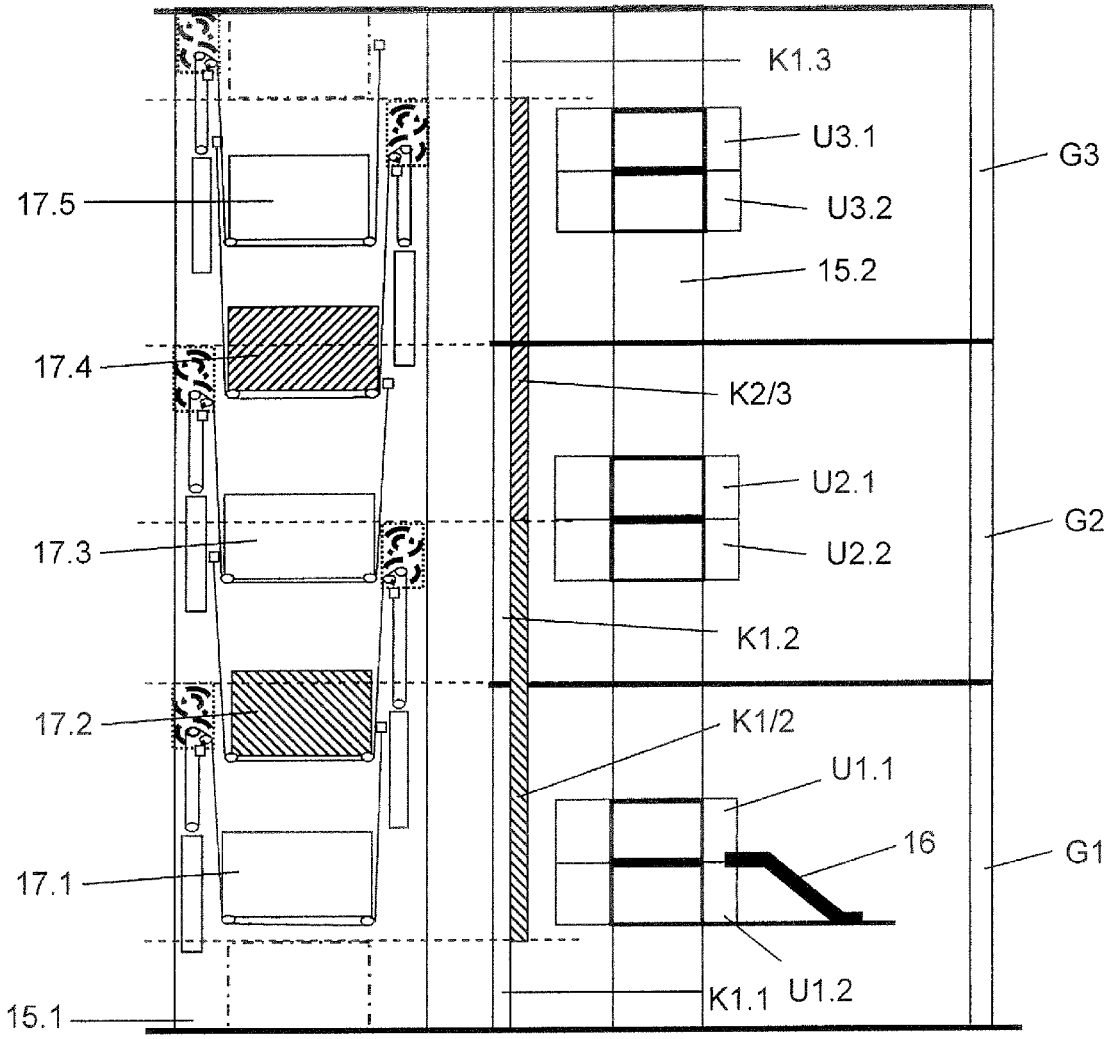
FIG. 7 is a schematic side view of an elevator installation with an alternative arrangement according to the present invention in a building with three building zones.

FIG. 7 describes the elevator installation in a building with three building zones G1, G2, G3 and two shafts 15.1, 15.2. Arranged in the first shaft 15.1 one above the other are five elevator units with corresponding elevator cars 17.1-17.5, which are independently movable in five car zones K1.1, K1/2, K1.2, K2/3, K1.3. The three building zones G1, G2, G3 each have two transfer floors U1.1, U1.2, U2.1, U2.2, U3.1, U3.2 which are each disposed in a middle region of the associated building zones G1, G2, G3.

The lowermost elevator car 17.1, the next-but-one elevator car 17.3 disposed thereabove and the uppermost elevator car 17.5 define each time three associated car zones K1.1, K1.2, K1.3, which substantially correspond with the three associated building zones G1, G2, G3. Two further elevator cars 17.2, 17.4 are disposed between these three elevator cars 17.1, 17.3, 17.5. These two elevator cars 17.2, 17.4 are movable in the two associated car zones K1/2, K2/3. These two car zones K1/2, K2/3 are arranged to extend over building zones. In the lowermost building zone G1 an escalator 16 transports passengers between the two transfer floors U1.1, U1.2.

Figure 8:
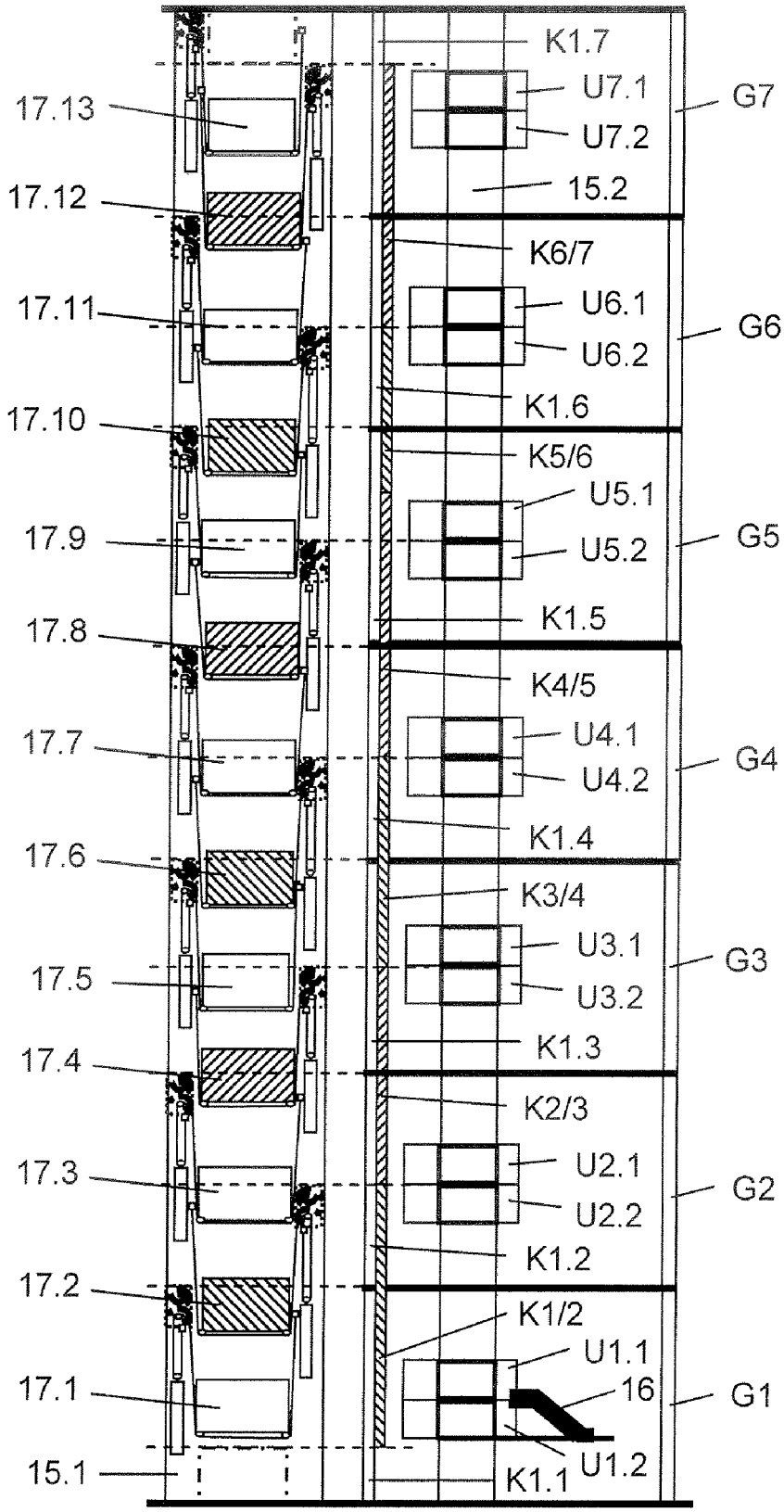
FIG. 8 is a schematic side view of an elevator installation with another alternative arrangement according to the present invention in a building with seven building zones.

FIG. 8 shows an elevator installation with a building zone division and car zone division as in the example of FIG. 7. The building has four additional building zones G4, G5, G6, G7 with associated transfer floors U4.1, U4.2, U5.1, U5.2, U6.1, U6.2, U7.1, U7.2 and four car zones K1.4, K1.5, K1.6, K1.7 with corresponding elevator cars 17.7, 17.9, 17.11, 17.13, which exclusively serve floors of associated building zones G4, G5, G6, G7. Added thereto are four car zones K3/4, K4/5, K5/6, K6/7 with corresponding elevator cars 17.6, 17.8, 17.10, 17.12, which are arranged to extend over the building.

The invention is not restricted only to the illustrated forms of embodiment. With knowledge of the invention it is obvious to the expert to optimize different parameters for specific forms of building. Instead of a double-decker car it is also possible for several or individual single cars or multi-cars, which have more than two cars connected together, to be moved in the second shaft 15.2. In addition, the number of floors allocated to a building zone "G" is freely selectable. The building zones "G" also do not need to have the same number of floors, but the number can vary from building zone to building zone. It is also not always necessary for only triple groups to be assigned to a building zone "G". Thus, quadruple, quintuple or sextuple groups, etc., can also be assigned to the building zones "G". The car zones do not have to be symmetrically constructed, for example, within a triple group. Depending on the position of the drives and the transfer floors these car zones "K" are freely adaptable to the specific building conditions. Finally, the transfer floors "U" can also be freely arranged with respect to number and position in a building zone "G" in dependence on the car zones "K" or number of cars of a multi-car.

The following simple calculation shows that thanks to the present invention a significant increase in conveying performance can be achieved. For a building zone G2 with, for example, twelve floors, according to the state of the art two elevator cars each serve eleven floors, i.e. each elevator car has per floor a transport coefficient of $1/11$ weighted by the number of floors to be served, which coefficient represents a measure for the conveying performance of the elevator car in a specific floor. This gives for the two boundary floors, which are each served only by one elevator car, a transport coefficient each of $1/11$ and, for a central region of eight floors where the two car zones overlap, a transport coefficient of $2/11$.

According to the example of FIG. 6 the following calculation results for a middle building zone G3: each elevator car moved in the building zone G3 has an associated car zone which embraces eight floors. Since each floor of the building zone G3 is served by two elevator cars, there results a continuous transport coefficient of $2/8$ or $1/4$. The conveying performance thus lies significantly above the values of a comparable elevator installation according to the state of the art.

In the second arrangement, which is shown in FIG. 8, of the elevator installation the transport coefficient for floors of a middle building zone G4 is calculated according to similar considerations as before. Each elevator car moved in the building zone G4 has an associated car zone embracing twelve floors. In this case as well each floor of the building zone G4 is served by two elevator cars. Thus, a transport coefficient of $2/12$ results for each floor of the building zone G4. In the case of serving of the middle floors at approximately the same frequency, the boundary floors in this example can be served significantly more frequently than in the case of an elevator installation according to the state of the art.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator installation in a building with at least two elevators, wherein the building is divided into at least two building zones that are arranged vertically one above the other and each elevator has at least one elevator car, each elevator car being independently movable by an associated drive in an associated car zone and each car zone having at least one transfer floor and at least one further floor, comprising:

a first one of the at least two elevators has at least three elevator cars arranged vertically one above the other in a shaft and which include a middle and two adjacent elevator cars, wherein said middle elevator car is independently movable in a middle car zone and said two adjacent elevator cars are independently movable in two associated adjacent car zones, said middle car zone and at least one of said adjacent car zones serve at least one common floor and that at feast one of said car zones is allocated to the at least two building zones in said shaft and at least another of said car zones is allocated to only one of the at least two building zones; and a second one of the at least two elevators having a high-speed car which exclusively serves the transfer floors of the building zones from a building lobby.

2. The elevator installation according to claim 1 wherein at least two adjacent building zones each have at least three car zones associated therewith.

3. The elevator installation according to claim 2 wherein said at least three car zones are a middle car zone associated with one of said at least two adjacent building zones and two adjacent car zones each associated with said one building zone and an adjacent upper or lower building zone.

4. The elevator installation according to claim 2 including at least three drives associated with said at least three elevator cars, wherein at least one of said at least three elevator cars can move past said drive associated with a lower adjacent one of said at least three elevator cars.

5. The elevator installation according to claim 4 wherein said at least three drives associated with said at least three elevator cars are each positioned at one of a first shaft wall and a second opposite shaft wall.

6. The elevator installation according to claim 5 wherein said drive of said middle elevator car is positioned at the first shaft wall and said two drives of said adjacent elevator cars are positioned at the second shaft wall.

7. The elevator installation according to claim 5 wherein said at least three drives are positioned in alternation on the first and second shaft walls.

8. The elevator installation according to claim 4 wherein said at least three drives are positioned at different shaft heights.

9. The elevator installation according to claim 8 wherein said drives associated with said adjacent elevator cars are arranged above or below said drive of said middle elevator car.

10. The elevator installation according to claim 8 wherein a distance in a vertical direction between said two drives associated with said middle elevator car and one of said adjacent elevator cars is at least one car height.

11. The elevator installation according to claim 1 wherein the drives each have at least one motor and an associated drive pulley driven by said at least one motor.

12. The elevator installation according to claim 11 wherein said at least one motor is arranged vertically above said associated drive pulley.

13. The elevator installation according to claim 11 wherein axes of said associated drive pulleys lie parallel to a first wall and a second opposite wall of the shaft.

14. The elevator installation according to claim 1 including a separate counterweight associated with each of said at least three elevator cars.

15. The elevator installation according to claim 14 wherein each said counterweight is guided by two counterweight guide rails.

16. The elevator installation according to claim 14 wherein each of said at least three elevator cars is movable along two car guide rails.

17. The elevator installation according to claim 16 wherein each of said counterweights is positioned between said car guide rails and one of a first wall and a second wall of the shaft.

18. The elevator installation according to claim 16 wherein said car guide rails form a connecting plane and including a tension means, a drive pulley and first and second deflecting rollers associated with each of said at least three elevator cars arranged at one side of the connecting plane.

19. The elevator installation according to claim 16 wherein said car guide rails form a connecting plane and including a tension means, a drive pulley and first and second deflecting rollers associated with each of said at least three elevator cars arranged at both sides of the connecting plane.

20. The elevator installation according to claim 14 including at least one tension means for supporting each of said at least three elevator cars.

21. The elevator installation according to claim 20 wherein each of said at least three elevator cars and said associated counterweight is suspended at a common tension means.

22. The elevator installation according to claim 20 wherein said at least one tension means is disposed in operative contact with an associated drive pulley.

23. The elevator installation according to claim 20 wherein said at least three elevator cars are suspended by said tension means in a block-and-tackle manner.

24. The elevator installation according to claim 23 wherein each of said at least three elevator cars has at least one first deflecting roller and at least one second deflecting roller mounted in a lower region of said at least three elevator oar cars.

25. The elevator installation according to claim 24 wherein each said at least one tension means is guided by a drive pulley and said first and second deflecting rollers to a fixing point.

26. The elevator installation according to claim 20 wherein said counterweights are suspended below the associated drives in a block-and-tackle manner by said tension means.

27. The elevator installation according to claim 26 wherein said counterweights have deflecting rollers fixed in an upper region of said counterweights.

28. The elevator installation according to claim 27 wherein said tension means are guided by drive pulleys via said deflecting rollers to fixing points.

29. The elevator installation according to claim 20 wherein said tension means consist of at least one cable or a double cable.

30. The elevator installation according to claim 20 wherein said tension means consist of at least one belt.

31. The elevator installation according to claim 30 wherein said belts are guided by drive pulleys and at least first deflecting rollers, second deflecting rollers and third deflecting rollers, only one side of said belts is disposed in contact with said drive pulleys and said third deflecting rollers and said belts are turned through 180° about a respective longitudinal axis thereof between said drive pulleys and said first deflecting rollers.

32. The elevator installation according to claim 20 a supporting structure of said tension means is formed from synthetic fibers.

33. The elevator installation according to claim 1 wherein each of the drives is fixed on a crossbeam in the shaft.

34. The elevator installation according to claim 33 wherein said crossbeams are fastened to at least one of car guide rails and counterweight guide rails in the shaft.

* * * * *